US009518244B2

(12) United States Patent
Bloch et al.

(10) Patent No.: US 9,518,244 B2
(45) Date of Patent: Dec. 13, 2016

(54) LUBRICANT COMPOSITION COMPRISING A BI-MODAL SIDE-CHAIN DISTRIBUTION LOFI

(71) Applicants: Ricardo A. Bloch, Scotch Plains, NJ (US); Doyle H. Boese, Plainfield, NJ (US); David J. Martella, Princeton, NJ (US)

(72) Inventors: Ricardo A. Bloch, Scotch Plains, NJ (US); Doyle H. Boese, Plainfield, NJ (US); David J. Martella, Princeton, NJ (US)

(73) Assignee: INFINEUM INTERNATIONAL LIMITED (GB)

( * ) Notice: Subject to any disclaimer, the term of this patent is extended or adjusted under 35 U.S.C. 154(b) by 291 days.

(21) Appl. No.: 13/937,387

(22) Filed: Jul. 9, 2013

(65) Prior Publication Data

US 2015/0018259 A1 Jan. 15, 2015

Related U.S. Application Data

(62) Division of application No. 11/949,083, filed on Dec. 3, 2007, now abandoned.

(51) Int. Cl.

*C10M 145/16* (2006.01)
*C10M 157/10* (2006.01)
*C10M 169/04* (2006.01)

(52) U.S. Cl.

CPC ..... *C10M 157/10* (2013.01); *C10M 169/041* (2013.01); *C10M 2203/1025* (2013.01); *C10M 2205/022* (2013.01); *C10M 2205/028* (2013.01); *C10M 2209/062* (2013.01); *C10M 2209/084* (2013.01); *C10M 2209/086* (2013.01); *C10N 2230/02* (2013.01)

(58) Field of Classification Search

CPC ..... C10N 2030/02; C10N 2230/02; C10M 2209/06; C10M 2209/08
USPC ..... 508/467
See application file for complete search history.

(56) References Cited

U.S. PATENT DOCUMENTS

| | | | | |
|---|---|---|---|---|
| 1,969,324 | A | 8/1934 | Poutter | 61/63 |
| 2,825,717 | A | 3/1958 | Dean et al. | 526/75 |
| 3,250,715 | A * | 5/1966 | Wyman | 508/467 |
| 3,551,336 | A | 12/1970 | Jacobsson et al. | 252/59 |
| 3,697,429 | A | 10/1972 | Engel et al. | 252/59 |
| 3,778,375 | A | 12/1973 | Braid et al. | 252/49.9 |
| 3,779,928 | A | 12/1973 | Schlicht | 252/75 |
| 3,852,205 | A | 12/1974 | Kablaoui et al. | 252/47.5 |
| 3,879,306 | A | 4/1975 | Kablaoui et al. | 252/51.5 A |
| 3,932,290 | A | 1/1976 | Koch et al. | 252/49.8 |
| 3,933,659 | A | 1/1976 | Lyle et al. | 252/32.7 E |
| 4,028,258 | A | 6/1977 | Kablaoui et al. | 252/46.7 |
| 4,105,571 | A | 8/1978 | Shaub et al. | 252/32.7 E |
| 4,176,074 | A | 11/1979 | Coupland et al. | 252/32.7 E |
| 4,344,853 | A | 8/1982 | Gutierrez et al. | 252/33.6 |
| 4,564,438 | A * | 1/1986 | Wang et al. | 208/33 |
| 4,772,674 | A * | 9/1988 | Shih et al. | 526/325 |
| 4,804,794 | A | 2/1989 | Ver Strate et al. | 585/12 |
| 4,839,074 | A * | 6/1989 | Rossi et al. | 508/467 |
| 5,891,831 | A * | 4/1999 | Matsuya et al. | 508/472 |
| 5,939,365 | A * | 8/1999 | Redpath et al. | 508/467 |
| 6,127,321 | A | 10/2000 | Emert et al. | 508/192 |
| 6,136,760 | A * | 10/2000 | Koenitzer et al. | 508/467 |
| 6,475,963 | B1 * | 11/2002 | Bloch et al. | 508/467 |
| 6,583,247 | B1 * | 6/2003 | Alvarino et al. | 526/227 |
| 6,869,919 | B2 * | 3/2005 | Ritchie et al. | 508/221 |
| 7,018,962 | B2 * | 3/2006 | Bloch et al. | 508/591 |
| 2004/0254082 | A1 * | 12/2004 | Bloch et al. | 508/591 |
| 2009/0143263 | A1 * | 6/2009 | Bloch et al. | 508/469 |

FOREIGN PATENT DOCUMENTS

| | | | |
|---|---|---|---|
| EP | 0296714 | A1 | 12/1988 |
| EP | 1086964 | A2 | 3/2001 |
| JP | 10310758 | A | 11/1998 |
| WO | WO-9828386 | A1 | 7/1998 |

OTHER PUBLICATIONS

"Polymers as Lubricating Oil Viscosity Modifiers", G. Ver Strate and M. J. Struglinski American Chemical Society 1991, pp. 256-272.

* cited by examiner

*Primary Examiner* — Ellen McAvoy

(57) ABSTRACT

A lubricant composition is disclosed. The lubricant composition is made up of (a) an API Group III base stock; (b) one or more semi-crystalline viscosity modifier; and (c) one or more LOFIs having a side-chain distribution which satisfies the following requirements: (1) the distribution contains side chains ranging from $C_8$ to $C_{18}$ with an average carbon number ranging from 12.4 to 14.4; (2) the side chain distribution is bi-modal with a lower portion of the bi-modal distribution made up primarily of $C_{12}$ and an upper portion of the distribution made up primarily of $C_{16}$, $C_{18}$ or combinations thereof; (3) the total mole % of the upper portion of the distribution must be less than that of the lower portion of the distribution; and (4) the amount of $C_{12}$ on the side chain must be at least 40 mole % of the total side chain distribution.

8 Claims, No Drawings

LUBRICANT COMPOSITION COMPRISING A BI-MODAL SIDE-CHAIN DISTRIBUTION LOFI

FIELD OF THE INVENTION

The present invention relates to lubricant compositions having improved flow properties, particularly lubricant compositions comprising American Petroleum Institute (API) Group III base stocks which exhibit improved low temperature flow properties.

BACKGROUND OF THE INVENTION

Lubricant compositions are used in various applications such as automotive applications, industrial applications, etc. Lubricant compositions are typically formulated from a base stock and one or more additives.

Various additives for use in lubricant compositions are well known in the art. Examples of such additives include, but are not limited to, lube oil flow improvers (LOFIs), viscosity modifiers (VMs), etc.

Automobile manufacturers and government regulators have introduced new, more stringent performance requirements for lubricants. Examples are the requirements for oil volatility and fuel efficiency. These changes have made the choice of base stock(s) used in lubricants much more important than they were in the past. Due to their low viscosity and low volatility, API Group III base stocks have become the base stock of choice for the next generation of lubricant compositions.

The present invention provides a lubricant composition having improved low temperature flow performance properties comprising (a) an API Group III base stock; (b) a semi-crystalline viscosity modifier; and (c) one or more LOFIs having a side-chain distribution which satisfies certain requirements.

SUMMARY OF THE INVENTION

In a non-limiting embodiment, the present invention is a lubricant composition comprising (a) an API Group III base stock; (b) a semi-crystalline viscosity modifier; and (c) one or more LOFIs having a side-chain distribution which satisfies the following requirements: (1) the distribution contains side chains ranging from $C_8$ to $C_{18}$ with an average carbon number ranging from 12.4 to 14.4; (2) the side chain distribution is bi-modal with a lower portion of the bi-modal distribution made up primarily of $C_{12}$ and an upper portion of the distribution made up primarily of $C_{16}$, $C_{18}$ or combinations thereof; (3) the total mole % of the upper portion of the distribution must be less than that of the lower portion of the distribution; and (4) the amount of $C_{12}$ on the side chain must be at least 40 mole % of the total side chain distribution.

DETAILED DESCRIPTION OF THE INVENTION

Unless otherwise indicated, all numbers expressing quantities of ingredients, reaction conditions, dimensions, physical characteristics, processing parameters, and the like, used in the specification and claims are to be understood as being modified in all instances by the term "about". Accordingly, unless indicated to the contrary, the numerical values set forth in the following specification and claims may vary depending upon the desired properties sought to be obtained by the present invention. At the very least, and not as an attempt to limit the application of the doctrine of equivalents to the scope of the claims, each numerical value should at least be construed in light of the number of reported significant digits and by applying ordinary rounding techniques. Moreover, all ranges disclosed herein are to be understood to encompass the beginning and ending range values and any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 5.5 to 10. Any mentioning of a U.S. patent or patent document or literature reference in the following description also incorporates by reference that document herein and is to be understood to be incorporated in its entirety.

As used herein, the following terms are defined in the manner described below.

The term "polymer" includes copolymers unless otherwise specifically stated to be limited to a polymer derived solely from the polymerization of a single monomer and encompasses branched as well as linear polymers.

The term "copolymer" refers to a polymer resulting from the polymerization reaction of two chemically different monomers. With reference to ethylene alphaolefin copolymers, it is understood that such copolymers can optionally contain a minor amount (for example, greater than zero but less than 10% by weight) of a nonconjugated polyene, in which case the copolymer is sometimes referred to as a terpolymer. With reference to ethylene alphaolefin polymers, it is understood both copolymers and terpolymers of ethylene with at least one other alpha-olefin are included.

The term "average carbon number" refers to the average carbon number weighted by molar fraction.

The term "lubricating oil flow improver" (LOFI) covers all additives which modify the size, number, and growth of wax crystals in lubricating (or lube for short) oils in such a way as to impart improved low temperature handling, pumpability, and/or vehicle operability as measured by such tests as pour point, Mini-Rotary Viscometer (MRV), and Scanning Brookfield Viscometer. The majority of lubricating oil flow improvers are polymers or copolymers, or contain polymers or copolymers. These polymers are generally side chain, backbone or mixtures thereof.

The term "base oil" refers to a refined fluid that is free of additives and is used as a component in a lubricant blend.

The term "base stock" refers to a blend, mixture, or similar of base oils.

Various "Groups" of base stocks, for example, API Group III base stocks, will be referred to herein. Those Group classifications have been established by the American Petroleum Institute (API) according to the table included in U.S. Pat. No. 6,475,963 which is hereby incorporated by reference.

The term "bi-modal" refers to a carbon chain length frequency distribution which has two distinct peaks (or modes) with each peak being a carbon chain length (or carbon chain lengths adjacent in terms of sequential even number of carbons) which has a higher mole percentage than neighboring carbon chain lengths. The bi-modal carbon chain length frequency distribution has a "lower portion of the distribution" and an "upper portion of the distribution".

The term "lower portion of the distribution" refers to the portion of the bi-modal distribution which is composed of the mode with the lower carbon chain length (or lengths) and adjacent carbon chain lengths (in terms of sequential even number chain lengths) of lower mole percent. The highest carbon chain length in the lower portion of the distribution is $C_{14}$.

The term "upper portion of the distribution" refers to the portion of the bi-modal distribution which is composed of the mode with the higher carbon chain length (or lengths) and adjacent carbon chain lengths of lower mole percent. The lowest carbon chain length in the upper portion of the distribution is $C_{16}$.

The term "primarily" means the amount of one component present in the composition, compound, etc. is more than the amounts of any other component present on a component-by-component basis.

The present invention is a lubricant composition comprising (a) a Group III base stock; (b) a semi-crystalline viscosity modifier; and (c) one or more LOFIs that meet certain specifications.

According to the present invention, the lubricant composition comprises an API Group III base stock. Group III base stocks as defined by the API have a viscosity index that is open-ended. In a non-limiting embodiment of the invention, the viscosity index of the base stock is greater than 120. In another non-limiting embodiment of the invention, the base stocks has a viscosity index of equal to or greater than 120 and equal to or less than 200. Suitable, commercially available Group III base stocks include, but are not limited to: the Visom brand of base stocks commercially available from ExxonMobil (Fawley, U.K.); the Yubase brand of base stocks commercially available from SK Corporation (Ulsan, South Korea); the Ultra-S brand of base stocks are commercially available from ConocoPhillips (Westlake, La. (USA)); and the Nexbase brand of base stocks commercially available from Neste (Porvoo, Finland).

In a non-limiting embodiment of the invention, the base stock is made using gas-to-liquids ("GTL") process. GTL is a refinery process used to convert natural gas or other gaseous hydrocarbons into longer-chain hydrocarbons. For example, GTL can be used to convert methane-rich gases into liquid fuels either via direct conversion or via syngas as an intermediate using the Fischer Tropsch process. As is well known in the art, isomerization catalyst can be used with GTL to make Group III base stocks According to the present invention, the lubricant composition comprises a semi-crystalline viscosity modifier. Typically, the semi-crystalline viscosity modifier comprises one or more high molecular weight hydrocarbon polymers as is well known in the art. Examples of suitable hydrocarbon polymers include copolymers of ethylene copolymerized with at least one additional alphaolefin monomer having from 3 to 30, for example, from 3 to 8 carbon atoms and which may be straight or branched. Optionally, a low concentration, e.g., less than about 10 wt. %, of a nonconjugated diene can be present. In a non-limiting embodiment, these copolymers are those comprising ethylene and propylene. Ethylene copolymers suitable for the present invention include tapered or block copolymers (including terpolymers, tetrapolymers, etc.) as well as those that have controlled compositional homogeneity and/or heterogeneity within and among copolymer chains which are well known in the art. Such copolymers are described in "Polymers as Lubricating Oil Viscosity Modifiers", G. VerStrate, M. J. Struglinski, Chapter 15; in "Polymers as Rheology Modifiers", D. N. Schulz and J. E. Glass, editors, American Chemical Society, Washington, D.C., 1991. The aforementioned articles are incorporated herein by reference to the extent permitted.

In a non-limiting embodiment of the invention, the semi-crystalline viscosity modifier is an oil-soluble polymer comprised of ethylene and a $C_3$ to $C_{18}$ alpha-olefin, the polymer being characterized by the following combination of parameters: (a) an average ethylene content within the range between 60 to 80 mole percent, wherein said polymer contains no more than 1.3% by weight of a polymer fraction which is insoluble in normal decane at 45° C.; (b) a degree of crystallinity less than 25%; (c) a weight average molecular weight/number average molecular weight ratio less than 4.0; and (d) a viscosity average molecular weight within the range between 10,000 and 200,000 Daltons. See U.S. Pat. No. 3,551,336 which is hereby incorporated by reference.

In another non-limiting embodiment of the invention, the semi-crystalline viscosity modifier is a segmented copolymer of ethylene and at least one other alpha-olefin monomer; each copolymer is intramolecularly heterogeneous and intermolecularly homogeneous and at least one segment of the copolymer, constituting at least 10% of the copolymer's chain, is a crystallizable segment. See U.S. Pat. No. 4,804,794 which is incorporated by reference.

In a non-limiting embodiment of the invention, the semi-crystalline viscosity modifier is included in combination with an amorphous viscosity modifier. An example of this is an oil-soluble polymer composition comprising a first copolymer of ethylene and a $C_3$ to $C_{18}$ alpha-olefin having an ethylene content of 50-95 mole percent and a second copolymer of ethylene and a $C_3$ to $C_{18}$ higher alpha-olefin having an ethylene content of 5-80 mole percent, the ethylene content of the first copolymer being at least 5 mole percent more than the ethylene content of the second polymer. See U.S. Pat. No. 3,697,429 which is hereby incorporated by reference.

In a non-limiting embodiment of the invention, the semi-crystalline viscosity modifier has a number average molecular weight ranging from 20,000 to 500,000 Daltons, for example, from 25,000 to 400,000 Daltons or from 30,000 to 300,000 Daltons as determined by gel permeation chromatography.

The semi-crystalline viscosity modifier can be present in the lubricant composition in an amount ranging from 0.05 to 5 wt. % of the polymer According to the present invention, the lubricant composition comprises one or more LOFIs having a side-chain distribution which satisfies the following requirements:

(1) Every side chain present comprises carbon chains made up of from 8 to 18 carbon atoms with an average carbon number from 12.4 to 14.4, for example, from 12.8 to 14.0 or from 13.0 to 13.8;
(2) the side chain distribution is bi-modal with the lower portion of the bi-modal distribution made up primarily of $C_{12}$ and the upper portion of the distribution (i.e., the distribution with the higher carbon number mode) made up primarily of $C_{16}$, $C_{18}$ or combinations thereof;
(3) the total mole % of the upper portion of the distribution must be less than that of the lower portion of the distribution; and
(4) the amount of $C_{12}$ on the side chain must be at least 40 mole %, for example, at least 50 mole % or at least 60 mole %, of the total side chain distribution.

In a non-limiting embodiment in which the essential components of the bi-modal distribution are made up of mixtures of (a) $C_{12}$ and $C_{16}$ or (b) $C_{12}$, $C_{16}$ and $C_{18}$, the amount of $C_{14}$ must be less than 20 mole %, for example, less than 10 mole % of the total side chain distribution.

In a non-limiting embodiment of the invention, the sidechains comprise even carbon number segments ranging from $C_8$ to $C_{18}$, i.e., $C_8$, $C_{10}$, $C_{12}$, $C_{14}$, $C_{16}$, $C_{18}$.

In a non-limiting embodiment, the LOFI is a dialkyl fumarate-vinyl acetate copolymer. The dialkyl fumarate-vinyl acetate copolymer can be formed from a mixture of alcohols having carbon numbers ranging from 8 to 18, with an average carbon number from 12.4 to 14.4, for example, from 12.8 to 14.0, or from 13.0 to 13.8. The copolymer is a sidechain copolymer having methylene segments as the side chains.

These LOFIs can contain pendent ester groups derived from a mixture of alcohols whereby the alcohol residue can be characterized as repeating methylene units, and which are oil soluble, or dispersible, polymeric compositions that generally have weight average molecular weights ranging from 50,000 to 350,000 Daltons as determined by gel permeation chromatography.

In a non-limiting embodiment of the invention, the dialkyl fumarate-vinyl acetate copolymer has a specific viscosity ranging from 0.3 to 1.5, for example, from 0.3 to 1.0 or from 0.45 to 0.7. In another non-limiting embodiment, the dialkyl fumarate-vinyl acetate copolymer has a weight average molecular weight ranging from 50,000 to 350,000 Daltons, for example, from 50,000 to 200,000 Daltons or from 75,000 to 120,000 Daltons.

In another non-limiting embodiment, the LOFI comprises poly(alkyl methacrylate) polymers. The poly(alkyl methacrylate) polymers comprises a copolymer (A) consisting essentially of an alkyl methacrylate (a1) and one or more monomers (a2). See U.S. Pat. No. 5,891,831 which is hereby incorporated by reference.

The amount of the alkyl methacrylate (a1) that constitutes the copolymer (A) may be generally from 30 to 99.99% by weight relative to the weight of the copolymer (A).

The alkyl methacrylate (a1) may generally include methacrylates with a linear alkyl group having from 1 to 18 carbon atoms (for example, methyl methacrylate, ethyl methacrylate, butyl methacrylate, 2-ethylhexyl methacrylate, decyl methacrylate, dodecyl methacrylate, tridecyl methacrylate, tetradecyl methacrylate, pentadecyl methacrylate, hexadecyl methacrylate, octadecyl methacrylate). Of these, preferred are alkyl methacrylates in which the alkyl moiety has from 8 to 18 carbon atoms.

The monomer (a2) is one or more to be selected from the group consisting of conjugated dienes, acetylene, substituted acetylene, alkyl vinyl ethers and alkyl allyl ethers. The amount of the monomer (a2) that constitutes the copolymer (A) may be generally from 0.01 to 10% by weight, preferably from 0.1 to 5% by weight, relative to the weight of the copolymer (A).

In yet another non-limiting embodiment, the LOFI comprises poly(alkyl acrylate) polymers. The poly(alkyl acrylate) polymers are acrylate or alkylacrylate copolymer derivatives having dispersing groups. See U.S. Pat. No. 6,869,919 which is hereby incorporated by reference.

In another non-limiting embodiment, the LOFI comprises poly(styrene-dialkyl maleate) polymers. See U.S. Pat. No. 4,564,438 which is hereby incorporated by reference.

The LOFI and one or more other components, excluding the base stock, in a lubricant composition are referred to as "additives".

In a non-limiting embodiment, the LOFI has a weight average molecular weight, as determined by gel permeation chromatography, ranging from 50,000 to 350,000 Daltons, for example from 80,000 to 200,000 Daltons.

In another non-limiting embodiment, the LOFI has a specific viscosity ranging from 0.3 to 1.0, for example, from 0.4 to 0.8.

The LOFI can be present in the lubricant composition in an amount ranging from 0.005 to 1.0 weight percent, for example from 0.05 to 0.5 weight percent.

The lubricant composition of the present invention can further comprise one or more of the optional components: corrosion inhibitors, oxidation inhibitors, friction modifiers, dispersants, anti-foaming agents, anti-wear agents, detergents, rust inhibitors, etc.

In a non-limiting embodiment, the lubricant composition of the present invention comprises a corrosion inhibitor. Corrosion inhibitors, also known as anti-corrosive agents, reduce the degradation of the metallic parts contacted by the lubricating oil composition. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 wt. percent of a sulfide of phosphorus for ½ to 15 hours, at a temperature in the range of 150° F. to 600° F. (66° C. to 316° C.). Neutralization of the phosphosulfurized hydrocarbon may be effected in the manner taught in U.S. Pat. No. 1,969,324.

In a non-limiting embodiment, the lubricant composition of the invention can comprise an oxidation inhibitor. Oxidation inhibitors reduce the tendency of mineral oils to deteriorate in service which deterioration can be evidenced by the products of oxidation such as sludge and varnish-like deposits on the metal surfaces, and by viscosity growth. Such oxidation inhibitors include alkaline earth metal salts of alkylphenolthioesters having preferably $C_5$ to $C_{12}$ alkyl side chains, e.g., calcium nonylphenol sulfide, barium t-octylphenyl sulfide, dioctylphenylamine, phenylalphanaphthylamine, phosphosulfurized or sulfurized hydrocarbons, etc.

In a non-limiting embodiment, the lubricant of the present invention comprises a friction modifier. Friction modifiers serve to impart the proper friction characteristics to lubricating oil compositions such as automatic transmission fluids. Representative examples of suitable friction modifiers are found in U.S. Pat. No. 3,933,659 that discloses fatty acid esters and amides; U.S. Pat. No. 4,176,074 that describes molybdenum complexes of polyisobutenyl succinic anhydride-amino alkanols; U.S. Pat. No. 4,105,571 that discloses glycerol esters of dimerized fatty acids; U.S. Pat. No. 3,779,928 that discloses alkane phosphonic acid salts; U.S. Pat. No. 3,778,375 that discloses reaction products of a phosphonate with an oleamide; U.S. Pat. No. 3,852,205 that discloses S-carboxyalkylene hydrocarbyl succinimide, S-carboxyalkylene hydrocarbyl succinamic acid and mixtures thereat U.S. Pat. No. 3,879,306 that discloses N-(hydroxyalkyl)alkenyl-succinamic acids or succinimides; U.S. Pat. No. 3,932,290 which discloses reaction products of di-(lower alkyl) phosphites and epoxides; and U.S. Pat. No. 4,028,258 that discloses the alkylene oxide adduct of phosphosulfurized N-(hydroxyalkyl) alkenyl succinimides. Preferred friction modifiers include succinate esters, or metal salts thereof, of hydrocarbyl substituted succinic acids or anhydrides and thiobis alkanols such as described in U.S. Pat. No. 4,344,853 as well as various molybdenum compounds.

In a non-limiting embodiment, the lubricant composition of the present invention comprises a dispersant. Dispersants maintain compounds resulting from oxidation during use that are insoluble or substantially insoluble in the oil, in suspension in the fluid thus preventing sludge flocculation and precipitation or deposition on metal parts. Suitable dispersants include high molecular weight alkyl succinates, the reaction product of oil-soluble polyisobutylene succinic anhydride with ethylene amines such as tetraethylene pentamine and borated salts thereof.

In a non-limiting embodiment, the lubricant composition of the present invention comprises a component to provide foam control. Foam control can be provided by an antifoamant of the polysiloxane type, e.g., silicone oil and polydimethyl siloxane.

In a non-limiting embodiment, the lubricant composition of the present invention comprises an anti-wear agent. Anti-wear agents, as their name implies, reduce wear of metal parts. Representatives of conventional anti-wear agents are zinc dialkyldithiophosphate and zinc diaryldithiophosphate.

In a non-limiting embodiment, the lubricant composition of the present invention comprises a detergent and metal rust inhibitor. Detergents and metal rust inhibitors include the metal salts of sulphonic acids, alkyl phenols, sulfurized alkyl phenols, alkyl salicylates, naphthenates and other oil soluble mono- and dicarboxylic acids. Highly basic (viz., overbased) metal salts, such as highly basic alkaline earth metal sulfonates (especially Ca and Mg salts) are frequently used as detergents. Representative examples of such materials, and their methods of preparation, are found in U.S. Pat. No. 6,127,321 based on an application originally filed Jul. 11, 1985.

The lubricant composition of the present invention can be made using methods and techniques which are well known in the art. Lubricant compositions according to the present invention are typically made by blending individual components into the base stock. For example, the components can be added directly to the base stock by dispersing, or dissolving the additives at the desired level of concentration at room temperature or elevated temperatures.

EXAMPLES

The present invention is illustrated by the following non-limiting examples. In the Examples, the lubricant compositions comprised a Group III base stock (Yubase base stock); a semi-crystalline viscosity modifier (Paratone 8451 from Chevron Oronite Company); and a LOFI which was prepared as described below. Each lubricant composition contained a different LOFI. For example, the lubricant composition of Example 1 contains LOFI 1, the lubricant composition of Example 2 contains LOFI 2 and so on.

Five LOFIs (LOFIs 1-5) were prepared by first making five dialkyl fumarate monomers (Dialkyl Fumarate Monomers 1-5) using a blend of alcohols having a distribution of carbon atoms as shown in Table I. Alcohol 1 in Table I is used to prepare Dialkyl Fumarate Monomer 1, Alcohol 2 in Table I is used to prepare Dialkyl Fumarate Monomer 2 and so on. 232 g of fumaric acid, 824 g of the specified alcohol blend, and 0.2 g Fascat 4100® were added to the round bottom flask equipped with a Dean-Stark apparatus. The slurry was stirred under a stream of nitrogen and slowly heated to 220° C. The esterification reaction was monitored by measuring the amount of water collected in the Dean-Stark trap. When the evolution of water ceased (typically 4 to 6 hours), the dialkyl fumarate monomer was decanted from the reactor and analyzed for neutralization number (2.0 mg KOH/g) and saponification number (223 mg KOH/g). Dialkyl Fumarate Monomers 1-5 were formed in this way.

The LOFIs were then prepared by making a dialkyl fumarate-vinyl acetate copolymer from the dialkyl fumarate monomers (formed in the step described above) as described below. Dialkyl Fumarate Monomer 1 was used to prepare Dialkyl Fumarate Vinyl Acetate Copolymer 1, Dialkyl Fumarate Monomer 2 was used to prepare Dialkyl Fumarate Vinyl Acetate Copolymer 2 and so on. 150 g of a Dialkyl Fumarate Monomer (Dialkyl Fumarate Monomers 1-5) were added to a Parr® brand, 300 $cm^3$ stainless steel reactor. The reactor was sealed, heated to 50° C., and flushed with nitrogen for 10 minutes. Then, 26.5 g of deoxygenated vinyl acetate were injected into the Parr® reactor containing the Dialkyl Fumarate Monomer. The mixture was stirred for 15 minutes before heating to the reaction temperature of 100° C. 0.26 g tert-butyl peroctoate was dissolved in 2.0 g Blandol® White Mineral Oil produced by Sonneborn and then injected into the mixture. The mixture was stirred for 5 to 8 hours to complete the polymerization reaction. The copolymer was then poured from the reactor into a round-bottom flask and stripped of volatiles on a rotary evaporator. Dialkyl Fumarate Vinyl Acetate Copolymers 1-5 were formed in this way.

Dialkyl Fumarate Vinyl Acetate Copolymers 1-5 were blended as is well known in the art with a Group III base stock (Yubase base stock) and a semi-crystalline viscosity modifier (Paratone 8451 from Chevron Oronite Company) to form the SAE 5W-30 lubricant compositions of Examples 1-5.

In Table I below, compositional information is provided for the LOFI Side Chains for Examples 1-5.

TABLE I

Distribution of Carbon Atoms in Alcohols 1-5

| | Alcohol 1 | Alcohol 2 | Alcohol 3 | Alcohol 4 | Alcohol 5 |
|---|---|---|---|---|---|
| $C_8$ [mole fraction] | 0 | 0 | 0 | 0 | .1 |
| $C_{10}$ [mole fraction] | 0 | 0 | .2 | 0 | .3 |
| $C_{12}$ [mole fraction] | .7 | .708 | .5 | .4 | 0 |
| $C_{14}$ [mole fraction] | .1 | .084 | 0 | .5 | 0 |
| $C_{16}$ [mole fraction] | 0 | .008 | 0 | .1 | .6 |
| $C_{18}$ [mole fraction] | .2 | .200 | .3 | 0 | 0 |
| Avg $C_n$ | 13.4 | 13.4 | 13.4 | 13.4 | 13.4 |

As stated previously, side chains of the LOFIs of the present invention must satisfy certain requirements. The various requirements are listed in Table II below. For the various exemplary lubricant compositions (Exs. 1-5) made in the manner described above, a "✓" appears in a box if the LOFI meets the requirement, and an "X" appears in a box if the LOFI does not meet the requirement.

TABLE II

| Requirement | Ex. 1 | Ex. 2 | Ex. 3 | Ex. 4 | Ex. 5 |
|---|---|---|---|---|---|
| (1) the distribution contains side chains ranging from $C_8$ to $C_{18}$ with an average carbon number from 12.4 to 14.4 | ✓ | ✓ | ✓ | ✓ | ✓ |

TABLE II-continued

| Requirement | Ex. 1 | Ex. 2 | Ex. 3 | Ex. 4 | Ex. 5 |
|---|---|---|---|---|---|
| (2) the side chain distribution is bi-modal with the lower portion of the bi-modal distribution made up primarily of $C_{12}$ and the upper portion of the distribution made up primarily of $C_{16}$, $C_{18}$ or combinations thereof | ✓ | ✓ | ✓ | X | X |
| (3) the sum of the upper portion of the distribution must be less than the lower portion of the distribution. This necessitates the amount of $C_{14}$ must be less than 20% or less than 10% when the essential components of the bimodal distribution are made up of mixtures of (a) $C_{12}$ and $C_{16}$ or (b) $C_{12}$, $C_{16}$ and $C_{18}$ and must be less than the sum of $C_{16}$ and $C_{18}$; | ✓ | ✓ | ✓ | X | X |
| (4) the amount of $C_{12}$ must be at least 40 mole % or at least 50 mole % of the total side chain distribution. | ✓ | ✓ | ✓ | ✓ | X |

As you can see, the LOFIs in the lubricant compositions of Examples 1-3 satisfy all of the requirements and are encompassed by the present invention. The LOFIs in the lubricant compositions of Examples 4 and 5 do not satisfy all of the requirements and fall outside of the present invention.

The lubricant compositions of Examples 1-5 were subjected to MRV Pumpability Test according to ASTM D 4684. The results of the test are shown in Table III.

TABLE III

| MRV Pumpability Test | | | | | |
|---|---|---|---|---|---|
| | Ex. 1 | Ex. 2 | Ex. 3 | Ex. 4 | Ex. 5 |
| At a Treat Rate of 0.50% | | | | | |
| Viscosity [mPa · s] | 27,200 | — | 24,400 | 161,100 | 54,200 |
| Yield Stress [Pa] | <35 | — | <35 | <350 | <140 |
| At a Treat Rate of 0.20% | | | | | |
| Viscosity [mPa · s] | 23,800 | 21,400 | 22,400 | — | — |
| Yield Stress [Pa] | <35 | <35 | <35 | — | — |

— means yield stress and viscosity were not tested.

In order to pass the MRV Pumpability Test, a lubricant composition must exhibit a viscosity equal to or less than 60,000 mPa·s and a yield stress of less than 35 Pa. At a treat rate of 0.50%, only Examples 1 and 3 passed the MRV Pumpability Test. At a treat rate of 0.20%, only Examples 1-3 pass the MRV Pumpability Test. As stated above, Examples 1-3 are encompassed by the present invention.

What is claimed is:

1. A method for formulating a lubricant composition formed from Group III base oils which satisfies the requirements of the MRV Pumpability Test according to ASTM D4684 comprising the following steps: blending at least the following components:

(a) an API Group III base stock;

(b) one or more semi-crystalline viscosity modifier; and (c) one or more dialkyl fumarate-vinyl acetate copolymer LOFIs having a side-chain distribution which satisfies the following requirements:

(1) the distribution contains side chains ranging from $C_8$ to $C_{18}$ with an average carbon number ranging from 12.4 to 14.4;

(2) the side chain distribution is bi-modal with a lower portion of the bi-modal distribution made up primarily of $C_{12}$ and an upper portion of the distribution made up primarily of $C_{16}$, $C_{18}$ or combinations thereof;

(3) the total mole % of the upper portion of the distribution is less than that of the lower portion of the distribution; and (4) the amount of $C_{12}$ on the side chain is at least 40 mole % of the total side chain distribution;

whereby the lubricant composition exhibits a viscosity equal to or less than 60,000 mPa·s and a yield stress of less than 35 Pa when subjected to an MRV Pumpability Test according to ASTM D4684.

2. The method according to claim 1 wherein the semi-crystalline viscosity modifier includes an amorphous viscosity modifier.

3. The method according to claim 1 wherein the distribution contains side chains ranging from $C_8$ to $C_{18}$ with an average carbon number ranging from 12.8 to 14.0.

4. The method according to claim 1 wherein the semi-crystalline viscosity modifier comprises copolymers of ethylene copolymerized with at least one additional alphaolefin monomer having from 3 to 30 carbon atoms.

5. The method according to claim 1 wherein the semi-crystalline viscosity modifier comprises an ethylene alphaolefin copolymer containing an amount of one or more non-conjugated dienes.

6. The method according to claim 1 wherein the LOFI has a specific viscosity ranging from 0.3 to 1.0.

7. The method according to claim 1 wherein the LOFI is present in an amount ranging from 0.005 weight percent to 1.0 weight percent, based on the total weight of the lubricant composition.

8. The method according to claim 1 further comprising blending one or more components selected from the group consisting of corrosion inhibitors, oxidation inhibitors, friction modifiers, and/or dispersants.

* * * * *